US010823044B2

(12) United States Patent
Hügel

(10) Patent No.: US 10,823,044 B2
(45) Date of Patent: Nov. 3, 2020

(54) EXPANSION TANK FOR THE COOLANT OF FLUID-COOLED INTERNAL COMBUSTION ENGINES

(71) Applicant: MAN Truck & Bus AG, Munich (DE)

(72) Inventor: Dietmar Hügel, Nuremberg (DE)

(73) Assignee: MAN TRUCK & BUS SE, Munich (DE)

( * ) Notice: Subject to any disclaimer, the term of this patent is extended or adjusted under 35 U.S.C. 154(b) by 305 days.

(21) Appl. No.: 14/949,234

(22) Filed: Nov. 23, 2015

(65) Prior Publication Data

US 2016/0169084 A1 Jun. 16, 2016

(30) Foreign Application Priority Data

Dec. 10, 2014 (DE) ..... 10 2014 018 366

(51) Int. Cl.
*F01P 11/02* (2006.01)
*F01P 11/18* (2006.01)
*F01P 11/04* (2006.01)

(52) U.S. Cl.
CPC ..... *F01P 11/029* (2013.01); *F01P 11/18* (2013.01); *F01P 11/0238* (2013.01); *F01P 11/0285* (2013.01); *F01P 11/04* (2013.01)

(58) Field of Classification Search
CPC ..... F01P 11/029; F01P 11/18; F01P 11/0238; F01P 11/0285
USPC ..... 123/41.27
See application file for complete search history.

(56) References Cited

U.S. PATENT DOCUMENTS 1,606,167 A * 11/1926 King ..... G01F 23/167 73/302
3,076,479 A 2/1963 Kai
3,521,702 A 7/1970 Holmes
4,738,228 A * 4/1988 Jenz ..... F01P 11/029 123/41.27
5,163,506 A 11/1992 Attinger
(Continued)

FOREIGN PATENT DOCUMENTS

DE 41 07 183 C1 8/1992
DE 4107183 C1 8/1992
(Continued)

OTHER PUBLICATIONS

Russian Search Report, dated Apr. 11, 2019, 2 Pages.
Chinese Office Action, dated Feb. 19, 2019, 7 Pages.

*Primary Examiner* — Lindsay M Low
*Assistant Examiner* — Omar Morales
(74) *Attorney, Agent, or Firm* — Lucas & Mercanti, LLP

(57) ABSTRACT

An expansion tank for the coolant of a fluid-cooled machine, in particular a machine-operated water-borne vehicle or a truck includes at least one inlet connection arranged in the lower region of the expansion tank, and an outlet connection for connection of the expansion tank to a cooling circuit of an internal combustion engine. A filler nozzle is arranged in the upper region of the expansion tank and has a lower edge spaced from an expansion tank cover to limit the fill level. At least one valve seals the filler nozzle for filling the expansion tank and protects the cooling system from overpressure. Furthermore, an air volume in the expansion tank, which remains on maximum filling of the expansion tank with coolant, can be adjusted.

11 Claims, 3 Drawing Sheets

(56) References Cited

U.S. PATENT DOCUMENTS

| | | | | |
|---|---|---|---|---|
| 5,357,909 | A * | 10/1994 | Attinger | F01P 11/0247 123/41.54 |
| 6,247,442 | B1 * | 6/2001 | Bedard | F01M 11/0004 123/184.21 |
| 2006/0118067 | A1 * | 6/2006 | Hewkin | F01P 11/0238 123/41.54 |
| 2011/0048345 | A1 | 3/2011 | Popadiuc et al. | |

FOREIGN PATENT DOCUMENTS

| | | | |
|---|---|---|---|
| DE | 42 33 038 | C1 | 11/1993 |
| DE | 4233038 | C1 | 11/1993 |
| DE | 4219892 | A1 | 12/1993 |
| DE | 10 2008 019 227 | A1 | 10/2009 |
| DE | 102010009757 | A1 | 8/2011 |
| EP | 0215 369 | A2 | 3/1987 |
| EP | 0160243 | B1 | 7/1988 |
| EP | 0 441 275 | A1 | 8/1991 |
| EP | 0441275 | A1 | 8/1991 |
| EP | 2492467 | A1 | 8/2012 |
| FR | 2884970 | A1 | 10/2006 |
| RU | 2217809 | C1 | 11/2003 |
| RU | 106660 | U1 | 7/2011 |

* cited by examiner

EXPANSION TANK FOR THE COOLANT OF FLUID-COOLED INTERNAL COMBUSTION ENGINES

CROSS-REFERENCE TO RELATED APPLICATIONS

The present application claims priority of DE 10 2014 018 366.1 filed Dec. 10, 2014, which is incorporated herein by reference.

BACKGROUND OF THE INVENTION

The invention concerns an expansion tank for the coolant of a fluid-cooled machine, in particular an internal combustion engine of a motor vehicle.

It is known in practice to produce coolant expansion tanks of the type cited initially which serve to receive the expanding coolant. FIG. 1 shows such a known expansion tank 10 in a highly diagrammatic view. The expansion tank 10 is normally constructed such that it is the highest point in the cooling system. The expansion tank 10 has an inlet connection in the lower area of the expansion tank 10 and an outlet connection for connecting the expansion tank 10 to the cooling circuit of the internal combustion engine (not shown). The expansion tank 10 furthermore has a filler nozzle 4 which is arranged in the upper part of the tank and has a lower edge 9 spaced from the cover of the expansion tank 14, to limit the fill level. Furthermore a valve 5 for sealing the filler neck 4 is provided which serves to protect the cooling system against over-pressure and via which the expansion tank 10 can be filled with coolant 1. The maximum fill level of the expansion tank 10 normally corresponds to filling with coolant 1 up to the lower edge 9 of the filler nozzle 4, as shown in FIG. 1, when the engine is cold.

In operation, due to the heating and resulting expansion of the coolant, a pre-pressure is produced in the air volume 2 of the expansion tank 10. The pressure in the cooling system is balanced via the valve 5 in the expansion tank closing cover. An increase in coolant temperature leads to a pressure rise in the cooling system since the coolant expands. As a result, the pressure in the expansion tank 10 rises, whereupon the over-pressure valve 5 in the cover opens and allows air and possibly also coolant to escape. When the coolant temperature normalises, a vacuum is created in the cooling system. Coolant is drawn back from the tank 10. Thus a vacuum also occurs in the tank 10. Then the vacuum compensation valve in the cover of the container 10 opens. Air flows into the container 10 until a pressure balance has been achieved. Reference numeral 3 designates the outer skin or outer wall of the expansion tank 30.

Further expansion tanks known from the prior art are disclosed for example in DE 10 2008 019 227 B4, DE 41 07 183 C1, EP 0215 369 B1, DE 42 33 038 C1 or EP 0 441 275 A1.

When filled with coolant 1 to the maximum level, conventional expansion tanks 10 have a fixedly defined air volume 2. If internal combustion engines with different coolant circuits are to be equipped with the same expansion tank 10, this leads to the following disadvantages: in cooling circuits with low heat input, it is not possible to achieve an adequate pre-pressure. In cooling circuits with high heat input however, the pre-pressure is dissipated via the valve 5 or coolant is expelled. These disadvantages can be avoided by providing different expansion tanks which are adapted to the particular cooling circuits in which they are used.

However this increases the number of variants and hence the development and component cost.

BRIEF SUMMARY OF THE INVENTION

It is therefore an object of the invention to provide an improved expansion tank with which the disadvantages of conventional expansion tanks can be avoided. The object of the invention is in particular to provide an expansion tank which can be better adapted to the requirements of different cooling circuits. The invention is furthermore based on the object of a cost-saving design of such an expansion tank.

An expansion tank according to an embodiment of the invention for the coolant of a fluid-cooled machine has at least one inlet connection arranged in a lower region of the expansion tank and an outlet connection for connecting the expansion tank to a cooling circuit of the internal combustion engine. The expansion tank furthermore comprises a filler nozzle which is arranged in an upper region of the expansion tank and has a lower edge spaced from the cover of the expansion tank to limit the fill level, and at least one valve sealing the filler nozzle for filling the expansion tank and protecting the cooling system from over-pressure. The fluid-cooled machine may in particular be a fluid-cooled internal combustion engine of a vehicle. A preferred application concerns a machine-operated water-borne vehicle or truck.

According to general aspects of the invention, said objects are achieved in that an air volume in the expansion tank, which remains on maximum filling of the expansion tank with coolant, can be adjusted, i.e., set variably.

This offers the advantage that the expansion tank can be adapted to the different requirements of different cooling circuits merely by altering the volume available for the air in the expansion tank.

In cooling circuits with low heat input, a small air volume may be set so that a sufficiently high pre-pressure can be built up. In cooling circuits with high heat input however, a large air volume may be set so that the pre-pressure built up is not too high and no coolant is expelled.

The expansion tank with variable air volume can thus be used as a uniform component in cooling circuits which differ in their composition, in particular their coolant heat input. A particular advantage of the invention is therefore the increased flexibility in setting the pre-pressure in the cooling circuit, and the cost-saving from standardization or variant reduction since one component can be adapted for use in different cooling circuits or cooling systems.

According to a preferred embodiment of the invention, to adjust the remaining air volume in the expansion tank, at least one air chamber—also referred to below as an air pocket—may be provided, comprising an air inlet opening which lies in the interior of the expansion tank above the lower edge of the filler nozzle and can be opened and closed with an assigned closing device. Due to the arrangement of the outlet opening above the lower edge of the filler nozzle, when the expansion tank is filled with coolant, the same maximum fill level is always ensured.

In other words, to form a variable volume for the air or in general a gas in the expansion tank, one or more air pockets may be provided which can each be brought into fluidic connection with the basic gas volume of the expansion tank by means of the assigned closing device (closing element), in order to increase the gas volume in the expansion tank. In the closed position of the closing element, the air pocket is closed so that the gas volume available is not increased.

The at least one air chamber may be arranged on the inside in the upper region of the expansion tank. According to a further variant, the at least one air chamber may also be arranged outside the expansion tank and be connected to the upper region of the expansion tank via a hose or pipe connection. These variants offer the advantage of modular construction.

To increase the flexibility in setting the pre-pressure in cooling circuits, the expansion tank may have at least two air chambers. The number and volume of the air chambers may be established as a function of a desired stages of air volume. One embodiment according to the invention provides that the inner volume of the air chambers has different sizes. The inner volume of the air chambers may however also have the same size.

The closing device assigned to an air chamber may be formed as a screw plug, a closing lid or a flap. This allows an economic embodiment for manual adjustment of the volume available for the air in the expansion tank.

According to a further embodiment, the closing device may be configured as a non-return valve, a spring-loaded valve or as a pneumatically or electrically controlled valve. This offers the advantage that the opening and closing of the air chambers may be pressure-dependent and/or automated, in particular during operation of a cooling circuit.

To prevent the penetration of coolant into the at least one air chamber, it is advantageous to arrange the air inlet opening of the at least one air chamber such that in operation of the expansion tank, no coolant can enter the at least one air chamber when this is opened. According to a further variant, a separate duct guide and/or diaphragm is provided.

A further aspect of the invention concerns a truck or a ship with at least one expansion tank as described above.

BRIEF DESCRIPTION OF THE DRAWINGS

The preferred embodiments and features of the invention described above may be combined arbitrarily. Further details and advantages of the invention are described below with reference to the enclosed drawings. In the drawings.

DETAILED DESCRIPTION OF THE PREFERRED EMBODIMENTS

Figure 1:
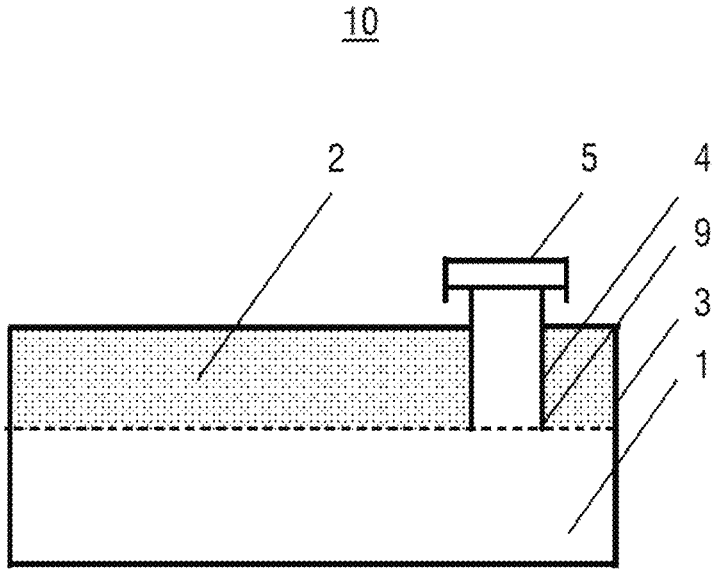
FIG. 1 Prior Art
FIG. 1 is a diagrammatic view of an expansion tank known from the prior art.

The same or functionally equivalent elements carry the same reference numerals in all figures. To avoid repetition, with reference to the function of elements 1 to 5 and 9 of FIGS. 2 and 3, reference is made to the relevant description of FIG. 1.

Figure 2:
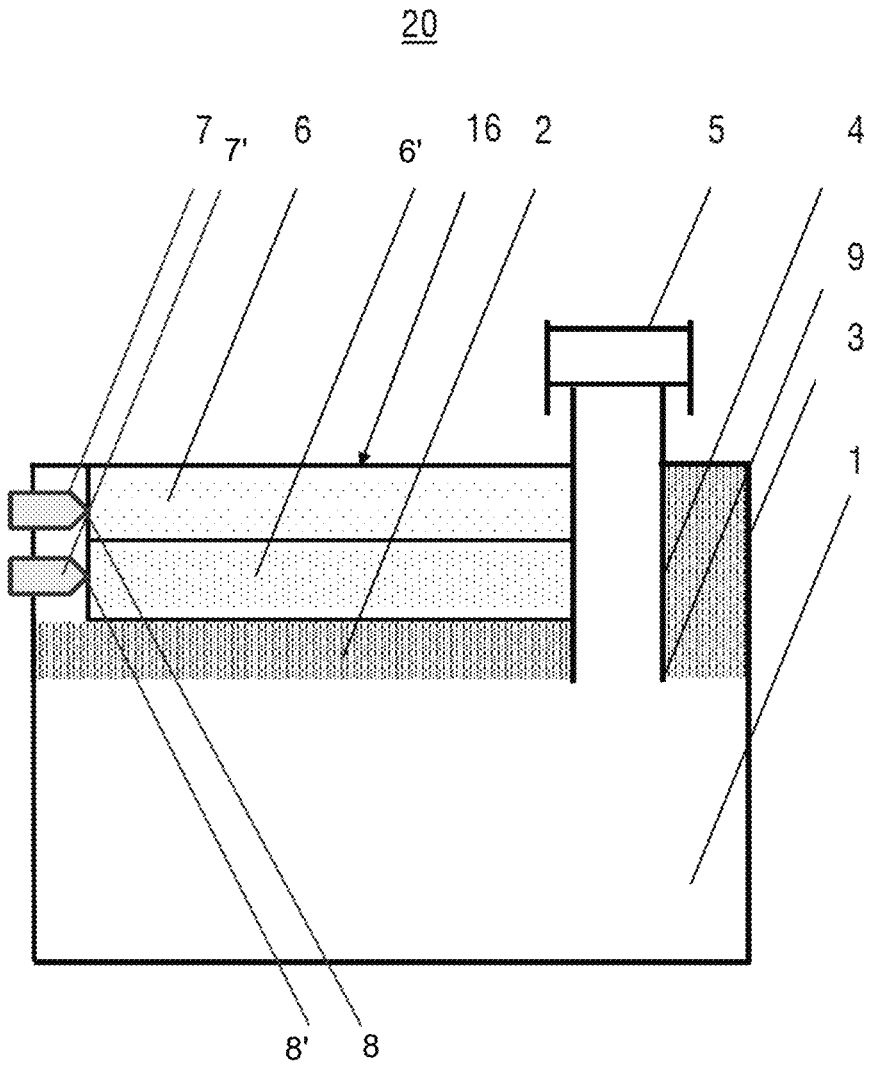
FIG. 2 is a diagrammatic view of an expansion tank according to an embodiment of the invention.
Figure 3:
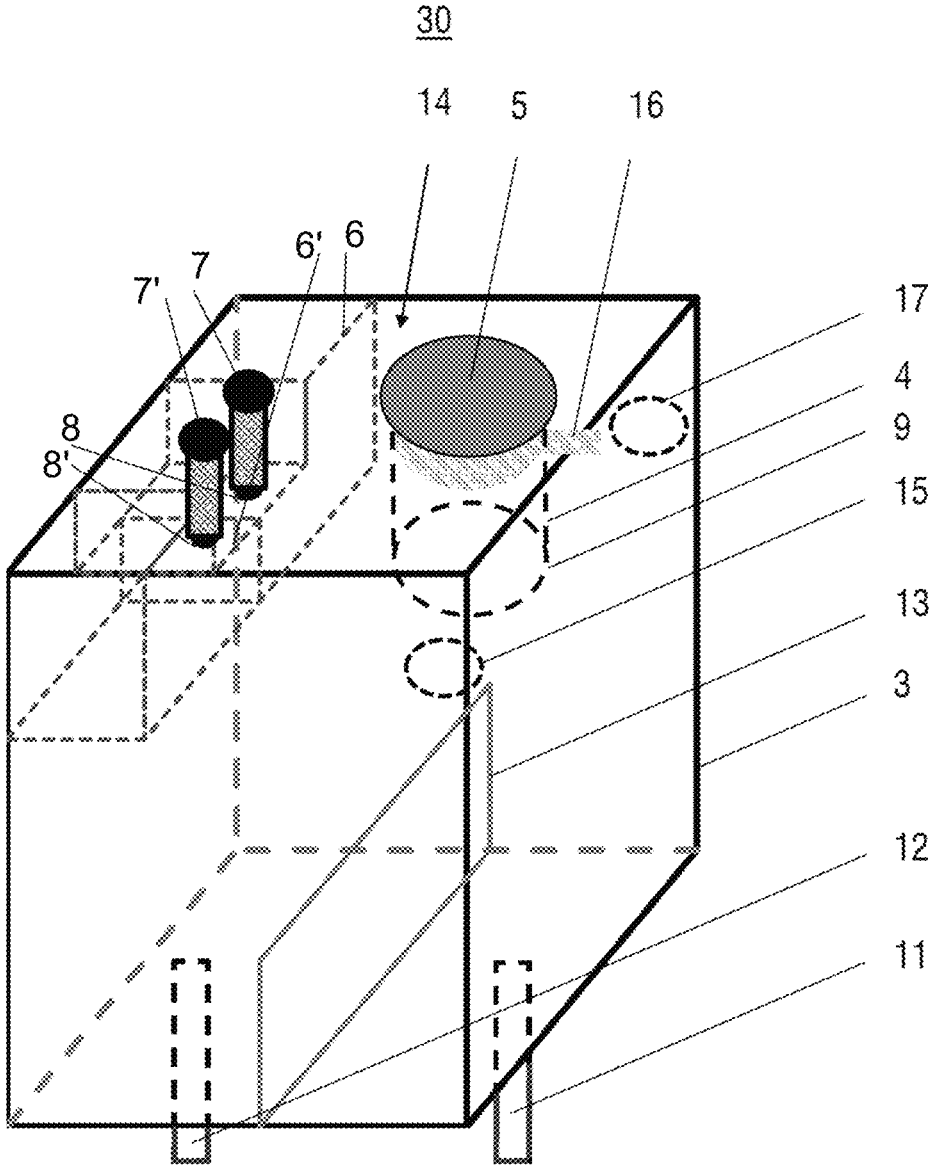
FIG. 3 is a diagrammatic view of an expansion tank according to a further embodiment of the invention.

The special feature of the expansion tanks 20 and 30 shown in FIGS. 2 and 3 lies in the two air pockets 6, 6' provided additionally, each of which has an assigned closing element 7, 7' with which each air pocket 6, 6' can either be opened or closed. In an open state, the air pocket 6, 6' is in fluidic connection with the basic gas volume of the expansion tank 20 or 30. Each of the air pockets 6, 6' has an air inlet opening 8, 8' which lies above the lower edge 9 of the filler nozzle 4 in the upper inner region of the expansion tank and can be closed with the closing element 7, 7'. When the air inlet opening 8, 8' is in the open state, the respective air pocket is fluidically connected to the upper interior of the expansion tank, so that air can flow into the opened air pocket 6, 6' from the basic volume. In a structurally simple embodiment, the closing element 7, 7' is configured as a screw plug.

The embodiment shown in FIG. 3 shows the supply connection 11 (not shown in FIGS. 1 and 2) arranged in the lower region of the expansion tank 10 and protruding into this, and the outlet connection 12 for connection of the expansion tank 10 to the cooling circuit of the internal combustion engine. The expansion tank 30 furthermore comprises—as already explained above—a filler nozzle 4 which is arranged in the upper region of the expansion tank 30 and has a lower edge 9 spaced from the cover of the expansion tank 14 to limit the fill level, and a valve 5 sealing the filler nozzle 4, which serves to protect the cooling system against over-pressure and via which the expansion tank 30 can be filled with the coolant 1. An overflow pipe 16 is arranged below the valve 5, via which fluid can flow out when the valve 5 is opened. Furthermore, in the expansion tank 30, a connection 15 is provided for a level sensor for fill level measurement and a connection 17 for pre-pressure measurement.

To improve the dissipation of air bubbles, a baffle element is provided in the lower inner region of the expansion tank 30, which is preferably formed as a partition 13. Such a partition has the function of changing the flow direction of the fluid and extending the flow path of the coolant in the expansion tank in order to dissipate as much air as possible.

As already explained above, two air chambers 6, 6' are provided below the expansion tank cover 14 in the upper region of the expansion tank 30 on the side opposite the valve 4, and the air inlet opening 8, 8' of these chambers 6, 6' can be closed or opened with a screw plug 7, 7'. The screw head here protrudes from the top of the expansion tank 30 and can be actuated from the outside. By adjusting the screw plugs 7, 7', the air chambers 6, 6' can be opened in order to vary the volume available inside the expansion tank for the air in the expansion tank and adapt this optimally to the respective coolant circuit.

As an example, a procedure is described below for adapting the expansion tank to a cooling circuit by adjusting the air volume available, e.g., during installation of the expansion tank 6, 6' in the vehicle. Here first the air volume required is determined depending on the coolant expansion, the pre-pressure required and the opening pressure of the valve 5. The air volume required is set in the expansion tank by the base volume, i.e., all air pockets 6, 6' are closed, or where applicable by the base volume and the specified number of required air pockets 6, 6' if a larger air volume has been determined.

The required number of air pockets 6, 6' is then opened, i.e., fluidically connected to the base volume, by means of the screw plug 7, 7'. The cooling circuit is then filled with coolant to the lower edge 9 of the filler nozzle 4 for the first fill. The engine is then operated until the cooling circuit is fully purged in order to remove any remaining air bubbles from the cooling circuit. Then when the engine is cold, coolant is added again up to the lower edge 9 of the filler nozzle 4. Then the pre-pressure is measured via the connection 17 while the engine is in real operation, in order to test the function of the expansion tank 30. If too high a pre-pressure is set or if the valve 5 blows off too early, a further air pocket 6, 6' can be opened. If the pre-pressure is too low, an air pocket 6, 6' may be closed. This offers the advantage that the expansion tank 30 can be adapted to the particular cooling circuit merely by changing the volume available for the air in the expansion tank.

Although the invention has been described with reference to specific exemplary embodiments, it is evident to the person skilled in the art that various changes may be made and equivalents used as replacement, without leaving the scope of the invention. In addition, many modifications can be made without leaving the associated area. Consequently, the invention is not limited to the exemplary embodiments disclosed, but comprises all exemplary embodiments which fall in the region of the attached claims. In particular, the invention also claims protection for the subject and features of the subclaims, irrespective of the claims to which reference is made.

LIST OF REFERENCE NUMERALS

1 Coolant
2 Air volume
3 Outer wall
4 Filler nozzle
5 Valve
6 Air chamber
7 Closing device
8 Air inlet opening
9 Lower edge
10 Expansion tank
11 Inlet connection
12 Outlet connection
13 Separating wall
14 Expansion tank cover
15 Connection for level sensor
16 Overflow pipe
17 Connection for pre-pressure measurement
20 Expansion tank
30 Expansion tank

The invention claimed is:

1. An expansion tank for coolant of a fluid-cooled machine, comprising:

an outer wall and an expansion tank cover;

at least one inlet connection arranged in a lower region of the expansion tank, and an outlet connection for connection of the expansion tank to a cooling circuit of the fluid-cooled machine;

a filler nozzle for filling the expansion tank arranged in the upper region of the expansion tank, the filler nozzle having a lower edge spaced from the expansion tank cover to limit the fill level to a maximum fill level;

at least one valve sealing the filler nozzle and protecting the cooling system from over-pressure; and at least one air chamber with an air inlet opening and a closing device, wherein the air inlet opening can be opened and closed by the closing device to adjust an air volume in an interior of the expansion tank that remains when the tank is filled to the maximum level and that is usable for producing a pre-pressure, wherein the air inlet opening fluidically connects the at least one air chamber to only an interior of the expansion tank when the air inlet opening is opened, whereby the at least one air chamber is not directly connected to an exterior of the expansion tank when the air inlet opening is opened.

2. The expansion tank according to claim 1, wherein the fluid-cooled machine is a fluid-cooled internal combustion engine of a vehicle.

3. The expansion tank according to claim 1, wherein the air inlet opening is disposed above the lower edge of the filler nozzle.

4. The expansion tank according to claim 1, wherein the at least one air chamber is arranged at least one of:

on an inside of the expansion tank in the upper region of the expansion tank; and outside the expansion tank and connected to the upper region of the expansion tank via a fluid line.

5. The expansion tank according to claim 1, wherein the at least one air chamber includes two air chambers.

6. The expansion tank according to claim 5, wherein inner volumes of the two air chambers are the same size.

7. The expansion tank according to claim 5, wherein inner volumes of the two air chambers are different sizes.

8. The expansion tank according to claim 1, wherein the closing device is one of a screw plug, a closing lid, and a flap.

9. The expansion tank according to claim 1, wherein the closing device is one of a non-return valve, a spring-loaded valve, and a pneumatically or electrically controlled valve.

10. The expansion tank according to claim 1, wherein the air inlet opening of the at least one air chamber is arranged such that in operation of the expansion tank, coolant is prevented from entering the at least one air chamber when the air inlet opening is opened.

11. A truck or ship with a fluid-cooled machine and an expansion tank according to claim 1.

* * * * *